United States Patent [19]

Hayatdavoudi, et al.

[11] Patent Number: 4,688,650

[45] Date of Patent: Aug. 25, 1987

[54] STATIC SEPARATOR SUB

[75] Inventor: Asadollah Hayatdavoudi, Lafayette, La.; Paul H. Dalier, Laurel, Miss.

[73] Assignee: Petroleum Instrumentation & Technological Services, Houston, Tex.

[21] Appl. No.: 801,469

[22] Filed: Nov. 25, 1985

[51] Int. Cl.[4] ..... E21B 21/08; B01D 21/26

[52] U.S. Cl. ..... 175/324; 175/65; 210/512.2; 210/788

[58] Field of Search ..... 175/65, 209, 231, 312, 175/324, 339; 210/512.1, 512.2, 787, 788

[56] References Cited

U.S. PATENT DOCUMENTS

| | | | |
|---|---|---|---|
| 2,056,498 | 10/1936 | Wright | 255/73 |
| 2,797,755 | 7/1957 | Bobo | 175/324 |
| 2,953,248 | 9/1960 | Troland | 210/512.1 |
| 3,566,980 | 3/1971 | Scroggins | 175/65 |
| 4,475,603 | 10/1984 | Hayatdavoudi . | |
| 4,488,607 | 12/1984 | Hayatdavoudi et al. | 175/65 |
| 4,539,105 | 9/1985 | Metcalf | 210/512.2 |

FOREIGN PATENT DOCUMENTS

| | | | |
|---|---|---|---|
| 0029977 | 3/1959 | Finland | 210/512.1 |

*Primary Examiner*—Stephen J. Novosad
*Assistant Examiner*—Terry Lee Melius
*Attorney, Agent, or Firm*—Laney, Dougherty, Hessin & Beavers

[57] ABSTRACT

A downhole separator sub for separating drilling mud into a more dense portion and a less dense portion. The apparatus includes a barrel having a central opening therethrough and a cyclone separator cartridge positioned in the central opening. The barrel is attachable to the drill string and the drill bit. The cyclone separator cartridge includes an upper insert, an intermediate cyclone separator housing and a loer insert. An annular flow passage is defined between the cyclone separator housing and an inner surface of the barrel. The upper insert includes an inlet passage providing communication between an upper portion of the barrel central opening and the annular flow passage. The lower insert includes a cyclone inlet providing communication between the annular flow passage and a cyclone chamber in the cyclone separator housing. A removable vortex finder tube is positioned in the cyclone separator housing and has an outlet hole through which less dense fluid is discharged into a lower portion of the barrel central opening. The upper insert also includes an underflow passage in communication with the cyclone chamber. The underflow passage has an outlet positioned adjacent transverse holes in the barrel through which more dense fluid is discharged from the apparatus into a well annulus. Alternate embodiments include deflectors adjacent the transverse holes in the barrel to prevent direct impingement of fluid on a wall of the well annulus and a sleeve interconnecting the upper and lower inserts to separate the annular flow passage from the remainder of the barrel central opening.

29 Claims, 6 Drawing Figures

STATIC SEPARATOR SUB

BACKGROUND OF THE INVENTION

1. Field Of The Invention

This invention relates to a downhole drilling apparatus which has a cyclone separator disposed therein for separating drilling mud into a more dense portion and a less dense portion, and more particularly, to an apparatus in which the cyclone separator includes an easily assembled multi-piece cartridge positionable in the central opening of a barrel, the barrel having an upper end engageable with a drill string and a lower end engageable with a drill bit.

2. Description Of The Prior Art

Separator subs of the general type disclosed in the present invention are known in the art. In particular, U.S. Pat. No. 4,475,603 to Hayatdavoudi and U.S. Pat. No. 4,488,607 to Hayatdavoudi and Adams are pertinent. Both of these references disclose a separator sub requiring complex assembly. An upper adapter, a lower adapter and an outer housing are heated to cause them to expand. An unheated cyclone housing formed by several segments which fit together in a tongue-in-groove fashion requiring an adhesive sealant therebetween are placed in the outer housing between the upper and lower adapters. The outer housing is then welded to the upper and lower adapters and cooled. Once cooled, the heated parts shrink so that the segments of the cyclone housing are held together by axial compression. The liquid adhesive sealant prevents leakage between the stacked segments.

The problem with such construction is there are a large number of individually machined, mating segments in the cyclone housing, requiring a sealant therebetween, and the heating operation during assembly is difficult and expensive. Further, the result is an integrally welded unit which cannot be disassembled easily for replacement of parts. The apparatus of the present invention solves these problems by having a cyclone separator assembly which is positionable in a barrel having an upper end attached to the drill string and a lower end attached to the drill bit. The cyclone separator assembly is easily removed from the barrel and disassembled into its various components for repair and replacement of worn parts. Further, components of different sizes appropriate for various drilling conditions may be used.

SUMMARY OF THE INVENTION

The separator sub apparatus of the present invention is designed for use in the drilling of a well with a drill bit supported by an elongated drill string having a bore through which a stream of drilling mud circulates to remove cuttings of the drill bit. The separator sub is used to separate drilling mud into a more dense portion and a less dense portion. In the less dense portion, the result is decreased viscosity, solids content, yield point, gel strength, sand content and fluid losses. The separation process also serves to classify the particle sizes.

The separator sub comprises a barrel portion having a central opening therethrough and a cyclone separator assembly positionable in the central opening such that an annular flow passage is defined between an outer surface of the cyclone separator assembly and an inner surface of the barrel.

The barrel has an upper end connectable to the drill string and a lower end connectable to the drill bit, both ends being in communication with the central opening. The barrel also defines at least one substantially transverse hole therethrough interconnecting the central opening therein with a well annulus.

The cyclone separator assembly comprises passageway means for interconnecting the annular flow passage with an upper portion of the barrel central opening, cyclone separator means, and cyclone inlet means for interconnecting the annular flow passage with the lower portion of the cyclone separator means. The cyclone assembly further comprises first conduit means for directing less dense fluid downwardly into a lower portion of the barrel central opening, and second conduit means for directing more dense fluid upwardly through the cyclone separator means and having outlets defining an operating position adjacent each barrel transverse hole.

Location means are provided for locating the second conduit means outlets in the operating position. The location means includes means for angular location and axial location.

Preferably, the cyclone separator assembly is characterized as a cartridge or insert comprising an upper portion defining the passageway means in the form of an inlet passage, an intermediate portion defining a cyclone chamber therein, and a lower portion which includes the cyclone inlet means in the form of a cyclone inlet in communication with the annular passage and cyclone chamber.

Sealing means are positioned between an outer surface of the upper portion and the inner surface of the barrel and between the outer surface of the lower portion and the inner surface of the barrel. The sealing means prevents any undesired fluid communication in the barrel central opening between the upper and lower central opening portions, the annular flow passage and the barrel transverse holes.

A vortex finder tube is positioned in the cyclone separator cartridge lower portion and the first conduit means includes an overflow outlet in the vortex finder tube in communication with a lower portion of the barrel central opening. The vortex finder tube is replaceable and is interchangeable with similar tubes of different sizes. In one embodiment the vortex finder tube is tapered.

The upper portion also defines an underflow passage between an upper portion of the cyclone chamber and the barrel transverse holes. This underflow passage and the cyclone chamber form the second conduit means in the preferred embodiment.

In an alternate embodiment, a passage interconnects the second conduit means and the annular flow passage. One-way flow means in the passage provides for fluid flow therethrough only from the annular flow passage toward the second conduit means so unprocessed fluid can clean the outlets and prevent clogging thereof.

An important object of the invention is to provide a separator sub which may be easily disassembled for repair or replacement of worn parts.

Another object of the invention is to provide a separator sub in which components of different sizes may be used interchangeably, such components including, but not limited to, vortex finder tubes of various diameters for correspondingly varying angular fluid velocity.

Still another object of the invention is to provide a separator sub having a tapered vortex finder tube for increasing the angular velocity of fluid therein.

Another object of the invention is to provide a separator sub having a barrel portion attachable to a drill string and a drill bit with a cyclone separator assembly positionable in a central opening of the barrel.

A further object of the invention is to provide a downhole tool having a barrel portion with an insert positioned therein and location means for angularly and axially locating the insert in a operating position.

Another object of the invention is to provide a separator sub having inlet passageway means for minimizing fluid flow therethrough.

Still another object is to provide a downhole tool having an outlet for discharging fluid therefrom and having one-way flow means for directing lighter fluid toward the outlet for cleaning thereof.

An additional object of the invention is to provide a separator sub having deflector means for preventing impingement against a wall of a well annulus by fluid discharged from the separator sub.

Additional objects and advantages of the invention will become apparent as the following detailed description of the preferred embodiments is read in conjunction with the accompanying drawings which illustrate such preferred embodiments.

DETAILED DESCRIPTION OF THE PREFERRED EMBODIMENT

Figure 1:
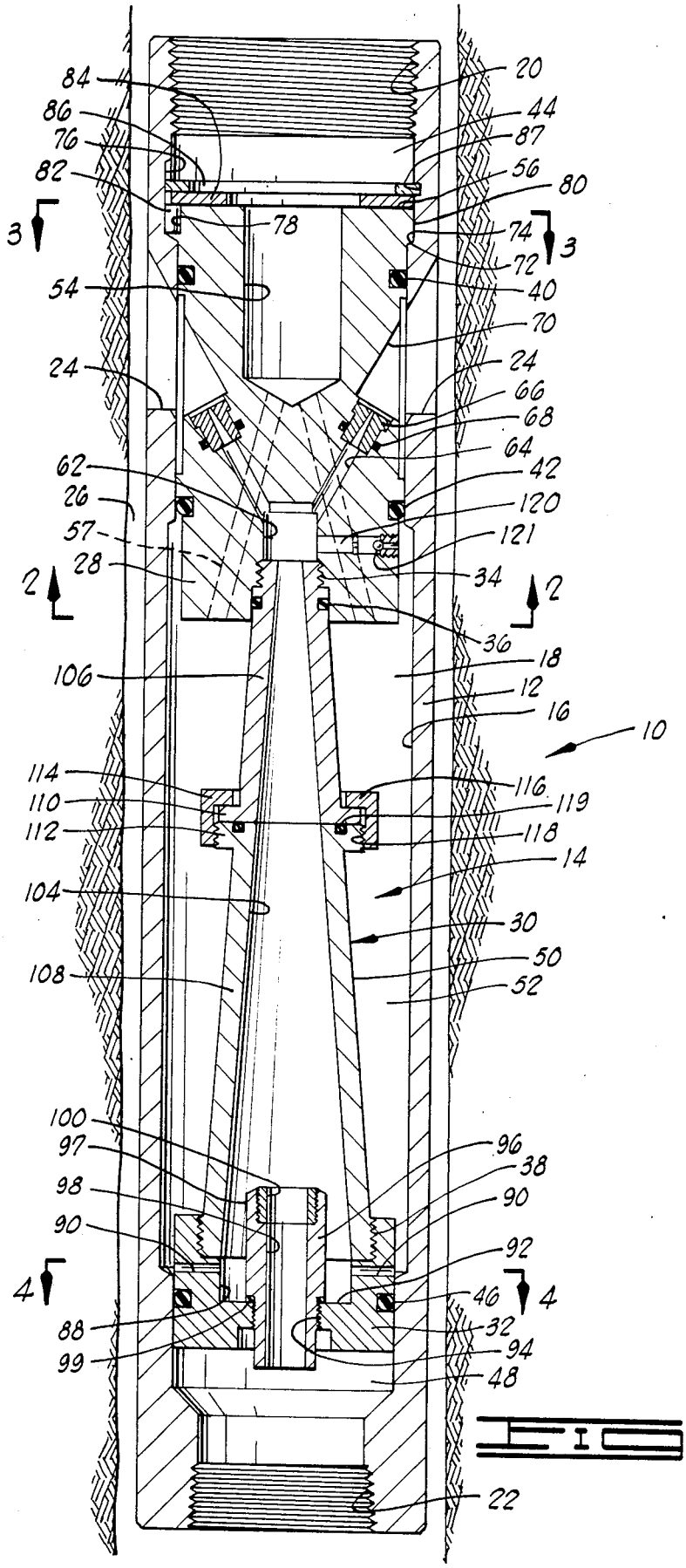
FIG. 1 is a longitudinal cross-sectional view of the separator sub of the present invention.

Referring now to the drawings, and more particularly to FIG. 1, the static separator sub of the present invention is shown and generally designated by the numeral 10. The major components of the separator sub are a substantially cylindrical barrel 12 and a cyclone separator assembly 14 sealingly engaged in the barrel.

Barrel 12 has an inner surface 16 defining a longitudinally disposed central opening 18 therethrough. An upper open end 20, in communication with central opening 18 is preferably internally threaded for engagement with the lower end of a drill string. A corresponding lower end 22, also in communication with central opening 18, is preferably internally threaded for engagement with the upper end of a drill bit.

Barrel 12 also defines at least one substantially transverse opening 24 therethrough which interconnects central opening 18 and a well annulus 26. In the preferred embodiment, there are a plurality of holes 24 circumferentially spaced around barrel 12. In the drawings, two such holes are illustrated.

Cyclone separator assembly 14 is made in the form of a preassembled cartridge or insert positionable in central opening 18 of barrel 12. Cyclone separator assembly 14 includes an upper insert portion 28, an intermediate cyclone housing portion 30 and a lower insert portion 32. An upper end 34 of cyclone housing 30 is threadingly engaged with upper insert 28 and sealed by seal 36. A lower end 38 of cyclone housing 30 is threadingly engaged with lower insert 32. Other types of fastener means could alternately be used.

In the preferred embodiment, upper insert 28 is positioned such that a seal 40, above transverse hole 24 in barrel 12, and another seal 42, below the transverse hole, isolate transverse holes 24 within central opening 18. Seal 40 also thus defines an upper inlet portion 44 of central opening 18.

Lower insert 32 has a seal 46 therearound which defines a lower outlet portion 48 of central opening 18.

As shown in FIG. 1, cyclone housing 30 has an outer surface 50 inwardly spaced from inner surface 16 of barrel 12. It will be seen by those skilled in the art that outer surface 50, inner surface 16 and seals 42 and 46 thus define an annular flow passage 52 therebetween.

Upper insert 28 defines a countersunk inlet cavity 54 extending from top surface 56 thereof.

Figure 2A:
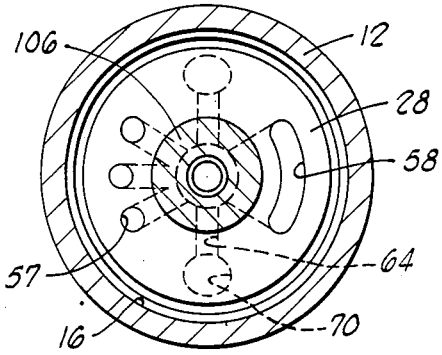
FIG. 2A is a transverse cross section taken along lines 2—2 in FIG. 1 showing two possible embodiments of the invention.
Figure 3:
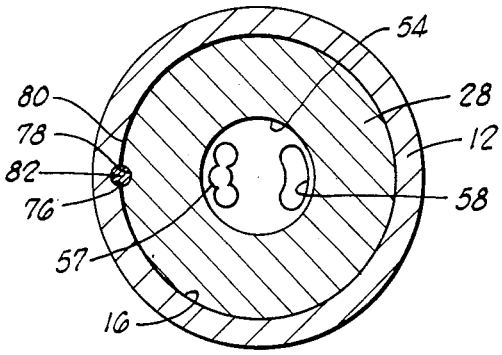
FIG. 3 shows a transverse cross-section view taken along lines 3—3 in FIG. 1 showing two embodiments.

Referring now also to FIG. 2A, two embodiments of the apparatus are shown. In one embodiment, a plurality of inlet ports 57 extend angularly outwardly and downwardly from a lower portion of inlet cavity 54 and open into an upper portion of annular flow passage 52. This first embodiment is also illustrated in FIG. 1. In the second embodiment, a curvilinear inlet slot 58 could be used. Both inlet ports 57 and slot 58 are shown in FIGS. 2A and 3 for purposes of illustration. Fluid pumped down the drill string into upper portion 44 of central opening 18 of barrel 12 will enter inlet cavity 54, pass through either ports 57 or slots 58 and enter annular flow passage 52. Thus, with either construction, ports 57 or slot 58 and inlet cavity 54 provide inlet passageway means between upper portion 44 of central opening 18 and annular flow passage 52.

Figure 2B:
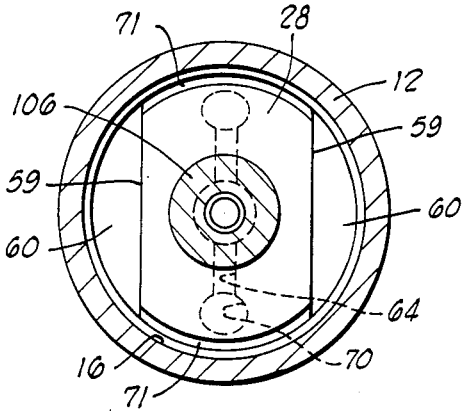
FIG. 2B is a transverse cross section taken along lines 2—2 in FIG. 1 showing another embodiment.

FIG. 2B illustrates still another embodiment of the inlet passageway means. In this other embodiment, upper insert 28 has two flat sides 59 which, together with barrel 12, define a pair of channels 60 therebetween. Channels 60 provide direct communication between upper portion 44 of central opening 18 and annular passage 52. The third embodiment of FIG. 2B is particularly applicable for use in small holes because the design is such that pressure losses through the inlet passageway means are minimized.

Referring again to FIG. 1, upper insert 28 also defines a lower outlet cavity 62. At least one outlet opening 64 extends angularly outwardly and upwardly from outlet cavity 62. Sealing positioned in the upper portion of each outlet opening 64 is a nozzle 66 and a seal 68 of a kind known in the art. At the upper end of each outlet opening 64, adjacent nozzle 66 is a counterbored fluid discharge cavity 70. When cyclone separator assembly 14 is in an operating position in barrel 12, each cavity 70 is positioned adjacent a corresponding transverse hole 24.

In the first two embodiments shown in FIGS. 2A and 3, seals 40 and 42 prevent fluid communication between the inlet passageway means and fluid discharge cavity 70 adjacent outlet opening 64. In the third embodiment of FIG. 2B, a partially annular seal 71 seals discharge cavity 70 from channels 60 forming the inlet passageway means.

Axial and rotational locating means locate upper insert 28 of cyclone separator assembly 14 in the operating position and prevent undesired movement thereof. As shown in FIG. 1, annular shoulder 72 of upper insert 28 bears against a corresponding shoulder 74 on inner surface 16 of barrel 12, thus axially positioning cyclone separator assembly 14.

Referring now to FIGS. 1 and 3, it will be seen that inner surface 16 of barrel 12 has a radially outwardly extending, substantially semi-cylindrical slot 76 therein adjacent upper end 56 of insert 28. A similar substantially semi-cylindrical slot 78 extends radially inwardly from outer surface 80 of upper insert 28. When cyclone separator assembly 14 is in the operating position, slots 76 and 78 together define a substantially cylindrical cavity in which is positioned a pin 82. It will thus be seen that pin 82 angularly locates and retains upper insert 28 in the operating position. A retainer plate 84 covers pin 82, keeping it in place, and bears against upper surface 56 of upper insert 28. Fastener means such as retainer ring 86 positioned in a groove 87 locks retainer plate 84 in position, thus preventing undesired upward movement of cyclone separator assembly 14.

Figure 4:
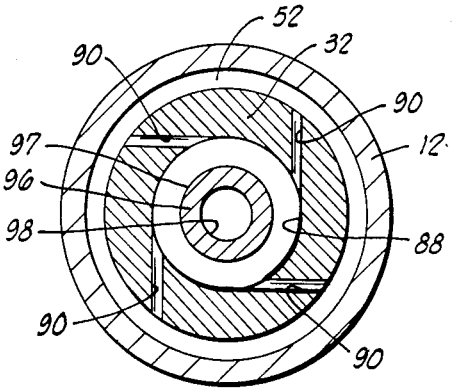
FIG. 4 is another transverse cross section taken along lines 4—4 in FIG. 1.

Referring now to FIGS. 1 and 4, lower insert 32 defines an upwardly opening central cavity 88 therein. A plurality of intermediate flow passageways 90 extend tangentially with respect to cavity 88 and act as a cyclone inlet means to interconnect cavity 88 with a lower portion of annular passage 52. Although four passageways 90 are shown in FIG. 4, the number and size of the passageways may be varied.

Extending from lower end 92 of cavity 88 is a threaded opening 94 in which is threadingly engaged a substantially coaxial vortex finder tube 96 with an outer surface 97. Vortex finder tube 96 has a central opening 98 therethrough in communication with lower outlet portion 48 of central opening 18 of barrel 12. A seal 99 prevents leakage of fluid past threaded opening 94. At the upper end of central opening 98 is threadingly engaged a removable insert 100 which is preferably made from a hard material such as tungsten to provide good resistance to errosion by fluid flowing thereby.

Figure 5:
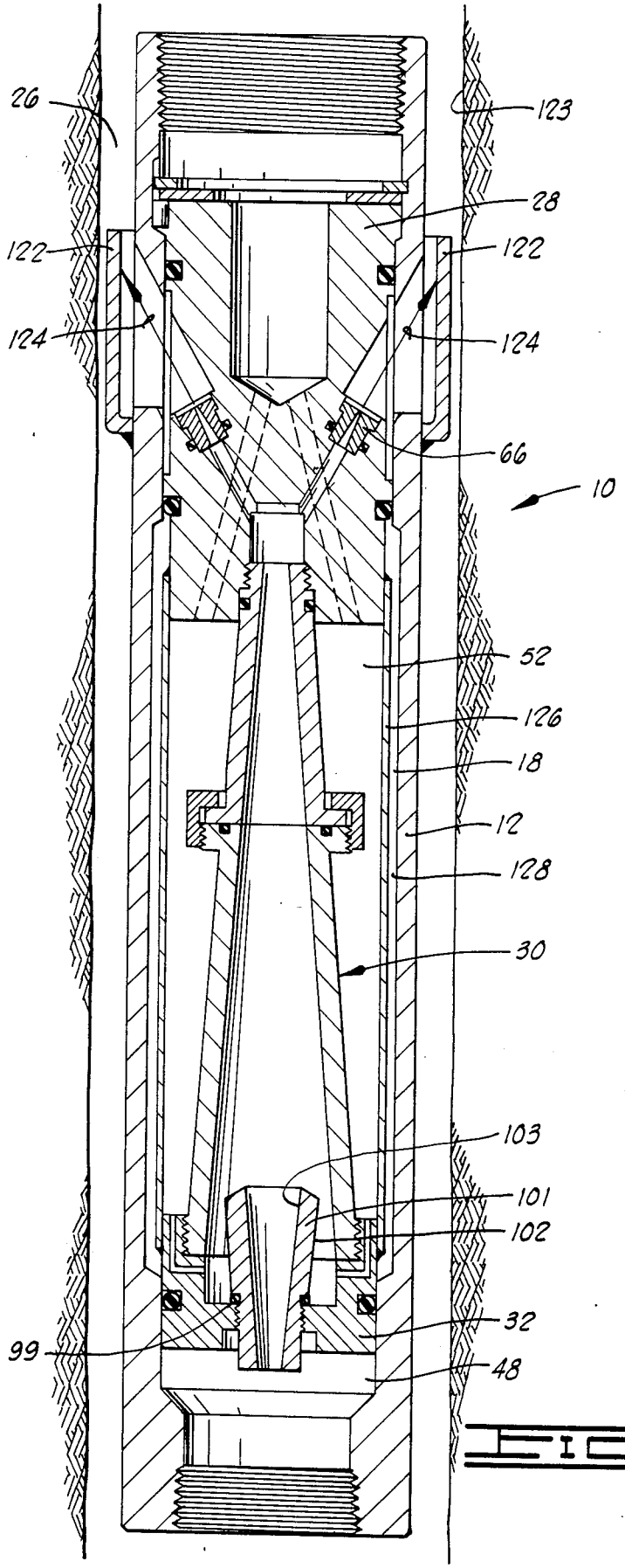
FIG. 5 is a longitudinal cross-sectional view showing optional embodiments of the apparatus.

An alternate, substantial conically shaped vortex finder tube 101 is shown in FIG. 5 and has a tapered outer surface 102. A substantially conical central opening 103 is defined through vortex finder tube 101. Although not shown, a removable insert could be installed in the upper end of central opening 103 as with the first embodiment.

Referring again to FIG. 1, cyclone housing 30 of intermediate cyclone separator assembly 14 is of substantially conical configuration defining a substantially conical cyclone chamber 104 therein tapering inwardly from bottom to top. Preferably, cyclone housing 30 includes an upper housing section 106 and a lower housing section 108. However, it will be obvious to those skilled in the art cyclone housing 30 could be made of one or more pieces. The velocity of fluid rotating in cyclone chamber 104 is greater at the upper end thereof, and therefore in the preferred embodiment, upper housing section 106 is made from a material harder than that of lower housing section 108 for erosion resistance. For example, but not by way of limitation, upper housing section 106 could be made from tungsten with lower housing section 108 manufactured from steel.

Upper housing section 106 has an outwardly directed flange 110 extending from a lower end thereof. At the upper end of lower housing section 108 is a corresponding externally threaded, outwardly directed flange 112 positioned adjacent flange 110. A locking ring 114 is located around upper housing section 106 and has an inwardly directed portion 116 which bears against an upper surface of flange 110 and a lower portion 118 internally threaded to engage flange 112. Thus, when locking ring 114 is tightened to the position shown in FIG. 1, it provides fastener means by which flange 110 of upper housing section 106 is rigidly clamped to flange 112 of lower housing section 108 to form the complete cyclone separator assembly 14. Seal 119 prevents passage of fluid between flanges 110 and 112.

Cyclone chamber 104 is in communication with cavity 88 of lower insert 32 so that fluid entering passageway 90 from annular chamber 52 flow rotationally therein. This rotational motion tends to separate the heavier and lighter fluids with the heavier fluids on the outside and the lighter fluids toward the center, as is known in the art.

The lighter fluids travel along outside diameter 97 of vortex finder tube 96 and are discharged downwardly through central opening 98 in the vortex finder tube. The diameter of outer surface 97 of vortex finder tube 96 determines the specific gravity of the fluid which eventually passes through central opening 98. By increasing outside diameter 97, the fluid velocity along the surface is increased which results in better separation of the fluids. Because vortex finder tube 96 is threadingly engaged in lower insert 32, it may be replaced by interchangeable vortex finder tubes with different outside diameters to correspondingly vary the fluid density as desired. Obviously, it can be replaced when repair is needed as well.

With alternate vortex finder tube 101 shown in FIG. 5, fluid again travels up tapered outside surface 102 and is discharged downwardly through conical central opening 103. Fluid traveling up outer surface 102 gradually increases in velocity with the increasing diameter, thus again resulting in better separation of the fluids.

Thus, with either vortex finder tube embodiment, a first conduit means is provided for directing less dense fluid into lower outlet portion 48 of central opening 18 of barrel 12 and down to the drill bit.

The rotation causes heavy fluids to travel upwardly through cyclone chamber 104 which at its upper end is in communication with outlet cavity 62 in upper insert 28. The heavy fluid then passes through outlet openings 64 and exits through nozzles 66. The heavy fluid is finally discharged from apparatus 10 through transverse holes 24 into well annulus 26. Outlet holes 64, nozzles 66 and cavity 70 thus define an underflow passage from cyclone chamber 104 to transverse holes 24. In this way, a second conduit means is provided for directing more dense fluid upwardly toward transverse holes 24 in barrel 12 and out of the apparatus. Upper insert 28 may be made from a hard material such as tungsten for fluid erosion resistance through the second conduit means.

An optional back flow port 120 is located through upper insert 28 to interconnect annular passage 52 with cavity 62. One-way flow means, such as back check valve 121, are provided so that fluid may pass from annular passage 52 into cavity 62, but will not flow in the opposite direction. In this way, a portion of unprocessed drilling fluid is conducted through one-way port 120 into outlet opening 64 toward nozzles 66. The purpose is to prevent clogging of the nozzles by the heavy fluid and to clean them as necessary.

Other optional features of apparatus 10 are shown in FIG. 5. One such feature is a fluid deflector 122 adjacent each hole 24 which is used to prevent direct impingement on wall 123 of well annulus 26 by a stream of fluid, represented by arrow 124, exiting nozzles 66. This prevents cutting of wall 123 by the high pressure fluid stream.

Another option is the use of a sleeve 126 which can be used to isolate annular flow passage 52 from a remaining annularly outer portion 128 of central opening 18 in barrel 12.

It can be seen therefore that the separator sub of the present invention is well adapted to carry out the ends and advantages mentioned as well as those inherent therein. While certain preferred embodiments of the invention have been illustrated for the purposes of this disclosure, numerous changes in the arrangement and construction of the parts may be made by those skilled in the art, and such changes are encompassed within the scope and spirit of the present invention as defined by the appended claims.

What is claimed is:

1. An apparatus for use in the drilling of a well with a drill bit supported by an elongated drill string having a bore through which a stream of drilling mud circulates to remove cuttings of the drill bit, said apparatus comprising:

a barrel defining a central opening therethrough and having an upper end connectable to said drill string, a lower end connectable to said drill bit, said upper and lower ends in communication with said central opening, and further defining a substantially transverse hole therethrough interconnecting said central opening with a well annulus; and a cyclone separator assembly removably and fixedly positioned in said central opening in said barrel, such that an annular flow passage is defined between an outer surface of said cyclone separator assembly and an inner surface of said barrel, said cyclone separator assembly comprising:

passageway means for interconnecting said annular flow passage with an upper portion of said barrel central opening;

cyclone separator means;

cyclone inlet means for interconnecting said annular flow passage with a lower portion of said cyclone separator means;

first conduit means for directing less dense fluid downwardly into a lower portion of said barrel central opening; and second conduit means for directing more dense fluid upwardly through said cyclone separator means and having an outlet defining an operating position adjacent said barrel transverse hole.

2. The apparatus of claim 1 further comprising location means for axially and rotationally locating said second conduit means outlet in said operating position relative to a longitudinal axis of said apparatus.

3. The apparatus of claim 1 further comprising deflector means adjacent said barrel transverse hole for deflecting fluid discharged therefrom and preventing direct impingement by said fluid on a wall of said well bore.

4. The apparatus of claim 1 further comprising one-way flow means interconnecting said annular flow passage and said second conduit means such that a portion of fluid entering said annular flow passage from said passageway means may flow from said annular flow passage into said second conduit means, but is prevented from flowing in an opposite direction.

5. An apparatus for use in the drilling of a well with a drill bit supported by an elongated drill string having a bore through which a stream of drilling mud circulates to remove cuttings of the drill bit, said apparatus comprising:

a barrel defining a central opening therethrough and a transverse hole in communication with said central opening and a well annulus, said barrel having an upper end connectable to said drill string and a lower end connectable to said drill bit; and a cyclone separator cartridge removably and fixedly positioned in said central opening of said barrel, said cartridge comprising:

an upper portion defining an inlet passage in communication with an upper portion of said barrel central opening and an underflow passage having an outlet positionable adjacent said barrel transverse hole;

an intermediate portion positioned such that an outer surface thereof and an inner surface of said barrel define an annular passage therebetween in communication with said inlet passage, said intermediate portion defining a cyclone chamber therein in communication with said underflow passage; and a lower portion defining a cyclone inlet in communication with said annular passage and said cyclone chamber, said lower portion including a vortex finder tube defining an overflow outlet for said cyclone chamber in communication with a lower portion of said barrel central opening.

6. The apparatus of claim 5 further comprising sealing means preventing direct communication between said annular passage and said upper and lower portions of said barrel central opening.

7. The apparatus of claim 5 further comprising locating means for locating said underflow passage outlet adjacent said barrel transverse hole and preventing axial and rotational movement therebetween.

8. The apparatus of claim 5 further comprising a deflector adjacent said transverse hole and positioned such that fluid discharged through said hole cannot directly impinge a wall of said well bore.

9. The apparatus of claim 5 wherein said upper, intermediate and lower cartridge portions are separable.

10. The apparatus of claim 5 wherein said intermediate cartridge portion comprises an upper section of a material harder than a lower section thereof.

11. The apparatus of claim 5 wherein said vortex finder tube is removable from said lower cartridge portion and interchangeable with vortex finder tubes of different sizes.

12. The apparatus of claim 5 wherein said vortex finder tube has a tapered outer surface.

13. The apparatus of claim 5 wherein:

said upper portion of said cyclone separator cartridge has a longitudinally extending, substantially flat surface thereon; and said inlet passage is characterized by a longitudinally extending opening defined between said flat surface and an inner surface of said barrel.

14. The apparatus of claim 13 further comprising sealing means preventing fluid communication between said opening and said underflow passage.

15. The apparatus of claim 5 wherein said upper portion further defines a back flow port therein interconnecting said annular passage with said underflow passage, said back flow port comprising one-way flow means therein such that fluid may travel therethrough only in a direction from said annular passage toward said underflow passage.

16. An apparatus for use in the drilling of a well with a drill bit supported by an elongated drill string having a bore through which a stream of drilling mud circulates to remove cuttings of the drill bit, said apparatus comprising:

a substantially cylindrical barrel having an upper end engageable with said drill string, a lower end engageable with said drill bit and an inner surface defining a longitudinally disposed central opening therethrough in communication with said upper and lower ends, said barrel further comprising a plurality of circumferentially spaced transverse holes therethrough;

a cyclone separator cartridge comprising:

an upper insert removably and fixedly sealingly engageable with said barrel inner surface such that an inlet portion of said central opening is defined thereabove, said upper insert defining an inlet passage and further having an underflow passage therethrough defining a plurality of outlet openings circumferentially spaced therearound corresponding to said barrel transverse holes and defining an operating position in which each underflow passage outlet is adjacent a barrel transverse hole;

an intermediate cyclone chamber housing attachable to said upper insert and having an outer surface inwardly spaced from said barrel inner surface such that an annular passage is defined therebetween, said annular passage being in communication with said inlet passage defined by said upper insert, said cyclone chamber housing further defining a cyclone chamber therein in communication with said underflow passage; and a lower insert attachable to said cyclone chamber housing sealingly engageable with said barrel inner surface face such that an outlet portion of said central opening is defined therebelow and having a vortex finder tube disposed substantially coaxially therewith, said tube defining an overflow outlet interconnecting said cyclone chamber and said outlet portion of said barrel central opening, said lower insert further defining a tangentially oriented cyclone inlet in communication with said annular passage; and locating means for locating said upper insert in said operating position.

17. The apparatus of claim 16 further comprising deflector means attached to said barrel for impingement of a wall of said well bore by fluid discharged from said overflow outlet through said transverse holes.

18. The apparatus of claim 16 further comprising sealing means for preventing fluid communication between said barrel transverse holes and said annular passage.

19. The apparatus of claim 16 wherein said intermediate cyclone chamber housing comprises:

an upper housing section;

a lower housing section attachable to said upper housing section; and fastener means for attaching said sections together.

20. The apparatus of claim 19 wherein said upper housing section is made from a material harder than said lower housing section.

21. The apparatus of claim 19 wherein:

said upper housing section includes an outwardly extending flange at a lower end thereof; and said lower housing section includes an outwardly extending flange at an upper end thereof, at least one of said flanges being externally threaded; wherein said fastener means comprising a lock ring positionable adjacent said non-threaded flange and having an internally threaded portion engageable with said threaded flange for clamping said flanges together.

22. The apparatus of claim 16 wherein said vortex finder tube is detachably mounted in said lower insert and is interchangeable with vortex finder tubes of different sizes.

23. The apparatus of claim 16 wherein said locating means comprises:

angular locating means; and axial locating means.

24. The apparatus of claim 23 wherein said angular locating means is characterized by:

said inner surface of said barrel defining a substantially semi-cylindrical slot extending outwardly therefrom;

an outer surface of said upper insert defining a substantially semi-cylindrical slot extending inwardly therefrom, such that said slots define a substantially cylindrical cavity therebetween when said upper insert is in operating position; and further comprising a pin positioned in said cavity for locking said upper insert in said operating position and preventing angular movement between said upper insert and said barrel.

25. The apparatus of claim 24 further comprising retaining means for preventing undesired removal of said pin from said cavity.

26. The apparatus of claim 23 wherein said axial locating means is characterized by:

said inner surface of said barrel defining an inwardly directed shoulder;

an outer surface of said upper insert defining an outwardly extending shoulder positionable against said shoulder on said barrel inner surface for preventing movement between said upper insert and said barrel in one direction; and retaining means for preventing axial movement between said upper insert and said barrel in a direction opposite said one direction.

27. The apparatus of claim 16 wherein said cyclone separator cartridge further comprises an annular sleeve interconnecting said upper and lower inserts and positioned between said outer surface of said cyclone chamber housing and said inner surface of barrel such that said annular flow passage is defined therein and has no fluid communication with an annularly outer portion of said central opening.

28. The apparatus of claim 16 wherein said upper insert has a flat surface thereon extending longitudinally from said inlet portion of said central opening of said barrel and said annular passage, said flat surface being spaced from said barrel inner surface such that said inlet passage is characterized by an opening defined between said flat surface and said barrel inner surface.

29. The apparatus of claim 16 wherein said upper insert further defines a back flow port with one-way flow means therein allowing fluid flow from said annular passage to said underflow passage, but preventing flow in an opposite direction.

* * * * *

UNITED STATES PATENT AND TRADEMARK OFFICE

CERTIFICATE OF CORRECTION

PATENT NO. : 4,688,650

DATED : August 25, 1987

INVENTOR(S) : Asadollah Hayatdavoudi and Paul H. Dalier

It is certified that error appears in the above-identified patent and that said Letters Patent are hereby corrected as shown below:

Abstract, line 8, delete "loer" and insert --lower-- therefor.

Column 4, line 49, delete "Sealing" and insert --Sealingly-- therefor.

Column 5, line 38, delete "substantial" and insert --substantially-- therefor.

Column 6, lines 9 and 10, delete "passageway" and insert --passageways-- therefor.

Claim 16, line 38, delete "face".

Claim 24, line 10, insert --said-- after "in" and before "operating".

Signed and Sealed this

Twenty-second Day of December, 1987

*Attest:*

DONALD J. QUIGG

*Attesting Officer*

*Commissioner of Patents and Trademarks*